US007582173B2

(12) United States Patent
Park et al.

(10) Patent No.: US 7,582,173 B2
(45) **Date of Patent: *Sep. 1, 2009**

(54) MONOLITHIC METALLIC GLASSES WITH ENHANCED DUCTILITY

(75) Inventors: Eun Soo Park, Gyeonggi-do (KR); Jong Hyun Na, Seoul (KR); Hye Jung Chang, Seoul (KR); Ju Yeon Lee, Daejeon (KR); Byung Joo Park, Seoul (KR); Won Tae Kim, Seoul (KR); Do Hyang Kim, Seoul (KR)

(73) Assignee: Yonsei University, Seoul (KR)

( * ) Notice: Subject to any disclaimer, the term of this patent is extended or adjusted under 35 U.S.C. 154(b) by 458 days.

This patent is subject to a terminal disclaimer.

(21) Appl. No.: 11/142,282

(22) Filed: Jun. 2, 2005

(65) Prior Publication Data

US 2006/0231169 A1 Oct. 19, 2006

(30) Foreign Application Priority Data

Apr. 19, 2005 (KR) ..... 10-2005-0032317

(51) Int. Cl.
*C22C 45/04* (2006.01)
*C22C 45/06* (2006.01)
*C22C 45/10* (2006.01)

(52) U.S. Cl. ..... 148/403; 148/426; 148/435; 420/457; 420/485

(58) Field of Classification Search ..... 148/403
See application file for complete search history.

(56) References Cited

U.S. PATENT DOCUMENTS

| | | | | |
|---|---|---|---|---|
| 5,032,196 | A * | 7/1991 | Masumoto et al. | 148/403 |
| 6,086,651 | A * | 7/2000 | Mizushima et al. | 75/246 |
| 6,172,589 | B1 * | 1/2001 | Fujita et al. | 335/306 |
| 6,427,753 | B1 * | 8/2002 | Inoue et al. | 164/80 |
| 6,692,590 | B2 * | 2/2004 | Xing et al. | 148/561 |
| 6,918,973 | B2 * | 7/2005 | Hufnagel et al. | 148/538 |
| 7,300,529 | B2 * | 11/2007 | Kuehn et al. | 148/403 |
| 2004/0112475 | A1 * | 6/2004 | Inoue et al. | 148/403 |
| 2005/0211340 | A1 * | 9/2005 | Kim et al. | 148/403 |
| 2006/0102315 | A1 * | 5/2006 | Lee et al. | 164/463 |
| 2006/0144475 | A1 * | 7/2006 | Inoue et al. | 148/403 |

* cited by examiner

*Primary Examiner*—George Wyszomierski
(74) *Attorney, Agent, or Firm*—Rosenberg, Klein & Lee

(57) ABSTRACT

Disclosed is a single-phase amorphous alloy having an enhanced ductility. The single-phase amorphous alloy has a composition range of $A_{100-a-b}B_aC_b$ where a and b are respectively $0<a<15$, $0\leqq b\leqq 30$ in atomic percent. Here, A includes at least one element selected from the group consisting of Be, Mg, Ca, Ti, Zr, Hf, Pt, Pd, Fe, Ni, and Cu. B includes at least one element selected from the group consisting of Y, La, Gd, Nb, Ta, Ag, Au, Co, and Zn. C includes at least one element selected from the group consisting of Al, In, Sn, B, C, Si, and P.

5 Claims, 4 Drawing Sheets

MONOLITHIC METALLIC GLASSES WITH ENHANCED DUCTILITY

BACKGROUND OF THE INVENTION

1. Field of the Invention

The present invention relates generally to a monolithic metallic glass alloy. More specifically, the invention relates to single-phase amorphous alloys having an enhanced ductility, in which the plastic deformation ability thereof is improved, while retaining a single-phase amorphous structure.

2. Description of the Related Art

In general, an amorphous metallic alloy has a high strength (~2 GPa), an excellent wear and corrosion resistance, and a large elastic elongation (~2%). Thus, for example, Zr-series amorphous alloys have been applied to sports equipment, high-strength parts or the like.

In particular, a bulk amorphous alloy has an ultrahigh strength and a high strength-to-weight ratio to thereby enable to provide for a high strength lightweight material, and also consists of a uniform microstructure, which thereby leads to a good corrosion and wear resistance.

Therefore, the bulk amorphous alloy technology has a significant influence on various other related technologies and industries, such as unclear atomic energy, aerospace, munitions industry, nano-technology, and the like.

As described above, amorphous metallic alloys have excellent mechanical properties, such as the ultrahigh strength and the broad elastic elongation region. However, in contrast, it does not allow for considerable plastic deformation at ambient or room temperature, thereby resulting in a limitation in their applications.

In order to overcome the above-mentioned limitations, i.e. to solve the poor processing flexibility due to the absence or lack of plastic deformation region, various attempts have been made. For example, elements not related to metallic glass formation are added such that fine precipitates can be formed to thereby provide a composite-like amorphous material.

U.S. Pat. No. 6,623,566 discloses a metallic glass alloy, in which nano particles are dispersed in an amorphous alloy matrix in order to enhance the ductility thereof. U.S. Pat. No. 6,692,590 discloses a method of forming a metallic glass, which consists of an amorphous alloy phase and a quasi-crystalline phase. In U.S. Pat. No. 6,669,793, an amorphous alloy is post-treated so as to form a dendrite phase, thereby enabling to be plastically deformed. In U.S. Pat. No. 6,709,536, a composite of an amorphous and dendrite phase is formed through a chemical treatment, and in U.S. Pat. No. 6,767,419, an amorphous coating is performed and then part of the amorphous coating is transformed into nano-scaled crystalline precipitates.

In these conventional techniques, however, ductile particles are formed in an amorphous matrix to thereby provide a composite-like material, or an amorphous alloy is post-treated so as to have a plastic deformation characteristic. As such, these conventional approaches are not favorable in terms of manufacturing time and cost and consequently in terms of the production efficiency, as compared with a single-phase amorphous alloy form having ductility.

In other words, the aforementioned conventional technique is configured such that ductile particles can be precipitated in an amorphous alloy matrix. Thus, elements unrelated to the amorphous phase formation must be added to form precipitates, thereby forming a composite-like material.

SUMMARY OF THE INVENTION

Therefore, the present invention has been made in view of the above problems in the art, and it is an object of the present invention to provide a single-phase amorphous alloy having an improved ductility, in which plastic deformation can be achieved at ambient or room temperature, while retaining the single-phase of amorphous structure.

To accomplish the above object, according to one aspect of the present invention, there is provided a single-phase amorphous alloy having an enhanced ductility. The single-phase amorphous alloy of the invention has a composition range of $A_{100-a-b}B_aC_b$ where a and b are respectively $0<a<15$, $0\leqq b\leqq 30$ in atomic percent. Here, A includes at least one element selected from the group consisting of Be, Mg, Ca, Ti, Zr, Hf, Pt, Pd, Fe, Ni, and Cu. B includes at least one element selected from the group consisting of Y, La, Gd, Nb, Ta, Ag, Au, Co, and Zn. C includes at least one element selected from the group consisting of Al, In, Sn, B, C, Si, and P.

In one embodiment of the invention, A includes Cu and Zr, B includes Y and Gd, and C includes Al.

In one embodiment of the invention, A includes Ni, Cu, Zr, and Ti, B includes Nb, and C includes Si.

In one embodiment of the invention, A includes Ni, Zr and Ti, B includes Nb, and C includes Si and Sn.

In one embodiment of the invention, A includes Zr and Cu, B includes Co, and C includes Al.

In one embodiment of the invention, A includes Cu, Zr, and Ti, B includes Ag, and C includes Al.

In an embodiment of the invention, A includes Zr and Cu, B includes La, Nb and Ta, and C includes Al.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Figure 1:
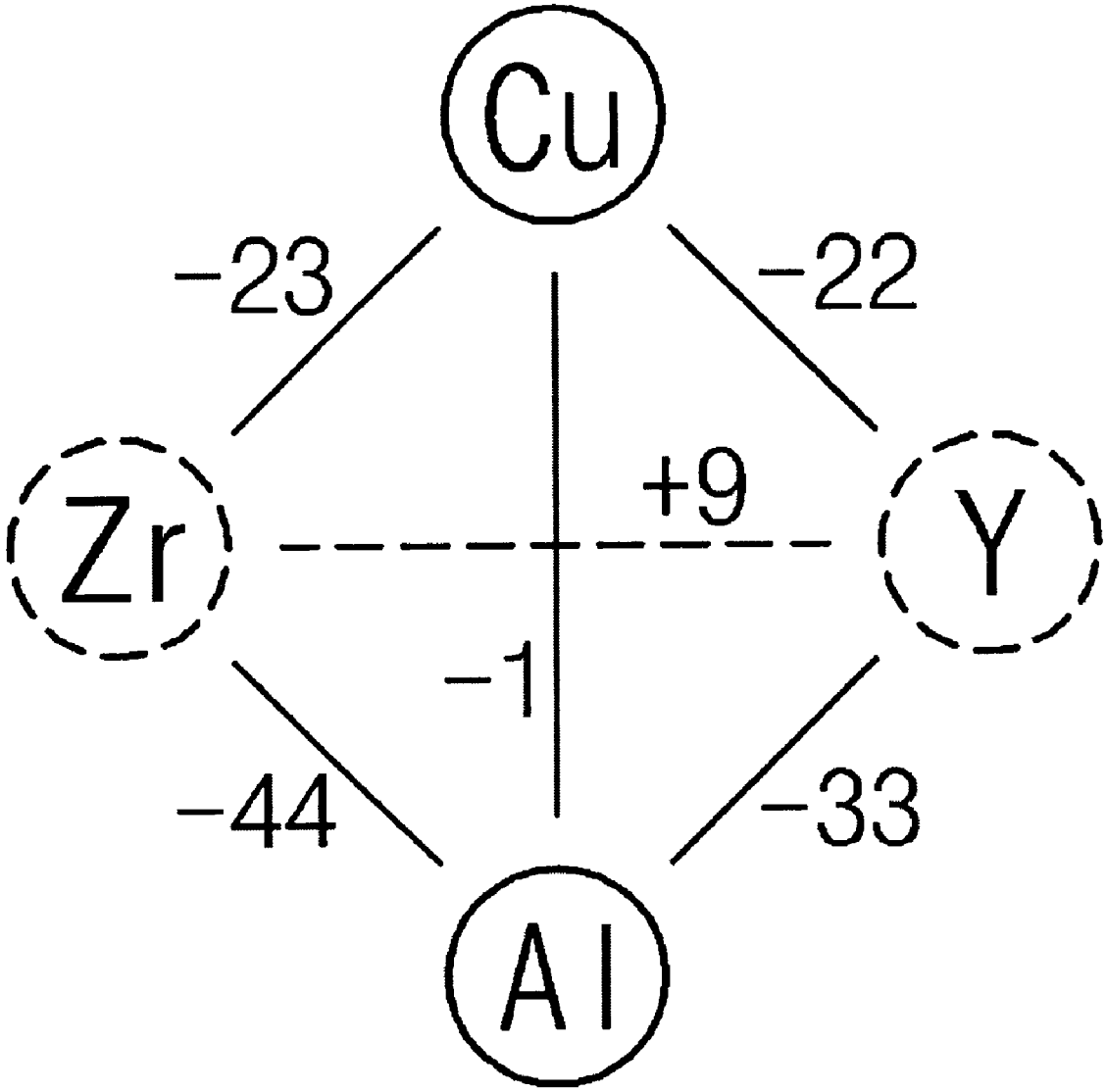
FIG. 1 is a schematic diagram explaining the enthalpy of mixing between the alloying elements in a Cu—Zr—Al—Y alloy system, which is an exemplary amorphous alloy according to the invention.

The preferred embodiments of the invention will be hereafter described in detail, with reference to the accompanying drawings.

In the present invention, a thermodynamic and structural behavior in the formation of an amorphous metal alloy has been considered. That is, part of alloying elements constituting an amorphous alloy is substituted by a certain other element, which provides a positive value of mixing enthalpy with at least one element of the alloy. Thus, a localized varying bonding relationship is caused in the alloy, thereby enabling to form a single-phase monolithic amorphous alloy having plasticity.

In other words, typical amorphous alloys are designed so as to have a dense packed atomic structure and provide a negative value of mixing enthalpy among the alloying elements.

In the above dense packed atomic structure, however, the alloying is formed, on the whole, through an attractive bonding relationship, and thus when in compressive deformation, a crack propagation is predominant, rather than expansion of a shear band. Thus, a rapid failure is likely to progress right after the elastic deformation region.

Considering the above-described facts, according to the invention, in an amorphous alloy where the alloying elements thereof have a negative enthalpy of mixing, part of the alloying elements is substituted with a certain element capable of providing a positive value of mixing enthalpy. Thus, a varying bonding relationship is caused locally in the alloy, i.e., a compositional non-homogeneity is occurred locally within the alloy. Eventually, a compositional fluctuation is provided inside the alloy material, so that a plastic deformation can be performed in an amorphous alloy at ambient or room temperature, while retaining a single-phase amorphous structure.

In other words, generally metal is crystallized during solidification from a liquid state. When a liquid metal is cooled, a compositional fluctuation occurs, due to diffusion process through the liquid phase. If the compositional fluctuation grows beyond a certain critical size, crystalline nuclei are created and grown into a crystalline phase.

The conventional amorphous alloy composition is designed such that the alloying elements thereof have a negative value of mixing enthalpy to thereby form a more dense packed liquid structure. Due to this structural characteristic, a compositional fluctuation range is limited within a critical size while being solidified, and thus formation of a crystalline nucleus is prohibited to thereby enable to form and retain an amorphous phase.

In terms of mechanical behaviors of the alloy, these microstructural characteristics may result in a large elastic elongation and an improved strength, due to the homogeneity thereof. However, it may lead to a brittle fracture in the plastic strain region.

Thus, an amorphous alloy according to the present invention contains an alloying element, which has a positive mixing enthalpy with at least one of other alloying elements. That is, a localized compositional fluctuation is caused between the constituents having a negative mixing enthalpy of attractive force and the constituents having a positive mixing enthalpy of repulsive force, thereby inhibiting the propagation and expansion of a crack, which is a significant for the failure of an amorphous material. That is, the above compositional fluctuation creates enormous shear bands to thereby effectively inhibit formation of a crack.

On the other hand, the amorphous alloy of the invention provides for a single-phase amorphous structure. Hereinafter, the single-phase amorphous alloy of the invention will be compared with a conventional composite-like amorphous alloy, in which a crystalline phase is dispersed in an amorphous matrix.

In general, it is known that an amorphous alloy has a short range order, but lacks a long range order in the atomic structure thereof, i.e., does not provide a systematic and ordered atomic-scale structure, and thus exhibits an isotropic property.

Due to these structural properties, the X-ray diffraction analysis for a single-phase amorphous alloy exhibits an halo diffraction pattern, which is characteristic of an amorphous alloy. In the image analysis, for example, in an optical microscopic observation, any other crystalline phases or structural defects such as a grain boundary are not detected.

Dissimilarly, the composite-like amorphous ally containing a crystalline phase in an amorphous matrix, for example, an amorphous alloy containing a ductile crystalline phase, has a crystalline phase having an ordered atomic structure in the alloy. That is, it contains a crystalline phase of particle form, which may be a crystalline phase formed inherently during the amorphous structure formation or externally added crystalline particles.

In the X-diffraction analysis of the above composite-like amorphous alloy, the crystalline peak characteristic of a crystalline material is appeared, along with the halo pattern characteristic of an amorphous material. The image analysis using an optical microscope exhibits a region differently contrasted with the amorphous matrix, due to the structural difference thereof.

In the composite-like amorphous materials, the interface between the amorphous matrix and the crystalline phase is unstable, and thus the coherency of the interface is of great importance in the mechanical properties of the composite-like amorphous materials. In contrast, the single-phase amorphous alloy of the invention does not form an interface, and thus, can be made into a single-phase amorphous material having an excellent ductility.

According to the above-described principles, the present invention provides a single-phase amorphous alloy having an improved ductility, which has a composition range of $A_{100-a-b}B_aC_b$ where a and b are respectively $0<a<15$, $0\leqq b\leqq 30$ in atomic percent. Here, A is at least one element selected from the group consisting of Be, Mg, Ca, Ti, Zr, Hf, Pt, Pd, Fe, Ni, and Cu. B is at least one element selected from the group consisting of Y, La, Gd, Nb, Ta, Ag, Au, Co, and Zn. In addition, C is selected from the group consisting of Al, In, Sn, B, C, Si, and P.

FIG. 1 is a schematic diagram explaining the mixing enthalpy between the alloying elements in a Cu—Zr—Al—Y alloy system, which is an exemplary amorphous alloy according to the invention;

As illustrated in FIG. 1, with respect to each bonding pair in the Cu—Zr—Al—Y alloy system, Cu—Zr, Cu—Al and Zr—Al pairs exhibit a negative mixing enthalpy of −23, −1, and −44 respectively.

In addition, yttrium Y with other elements, i.e., Y—Cu and Y—Al bonding pairs have a negative value of mixing enthalpy respectively of −22 and −33. However, the bonding pair Zr—Y exhibits a large positive value (+9) of mixing enthalpy.

In the multi-component alloy system, the negative mixing enthalpy is indicative of an attractive force between the concerned pair of alloying elements, and the positive value of mixing enthalpy is indicative of a repulsive force between the pair of elements.

Dissimilar to the Cu—Zr—Al alloy system where all the constituents provide a negative enthalpy relationships, in the present invention, the positive value of mixing enthalpy between the elements Zr and Y causes a repulsive force within the material, i.e., creates a localized weak bonding region in the alloy. Consequently, this difference in the bonding forces result in a compositional fluctuation inside the material, which allows for a plastic deformation at ambient or room temperature, while retaining a single-phase amorphous structure.

Figure 2:
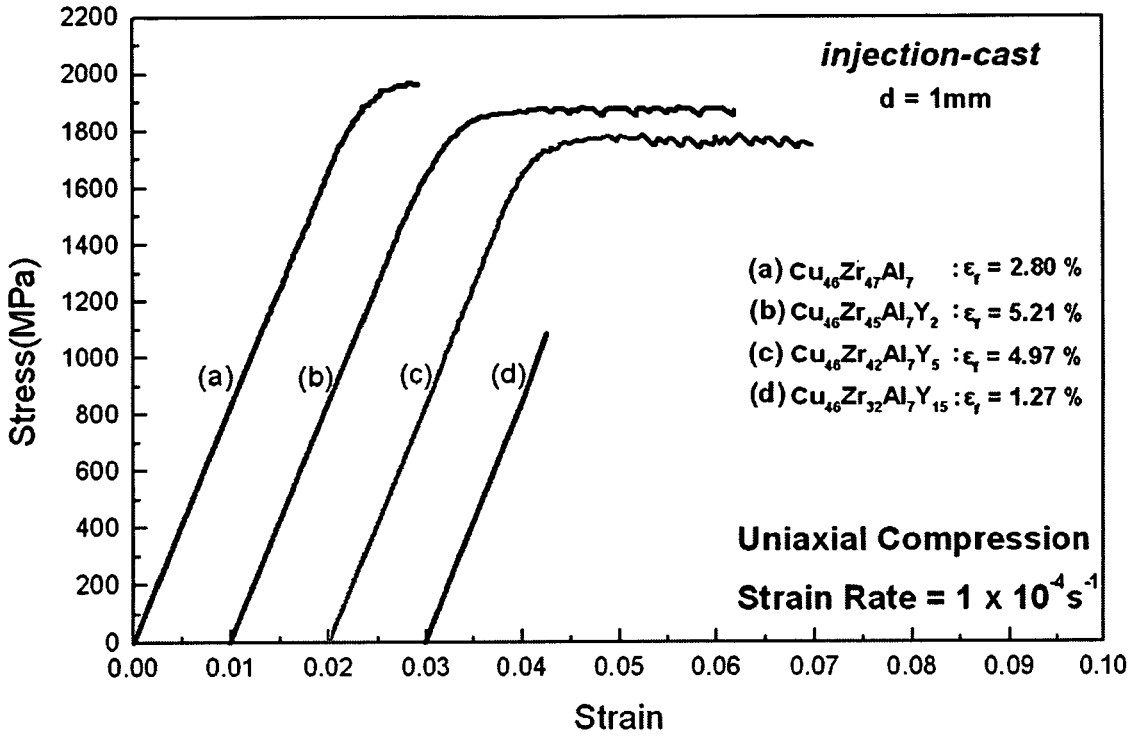
FIG. 2 is a plot of stress versus strain for the Cu—Zr—Al—Y alloy system, which is obtained using a uniaxial compression test.

FIG. 2 is a plot of stress versus strain for the Cu—Zr—Al—Y alloy system, which is obtained using a uniaxial compression test.

As can be seen from FIG. 2, in case of a $Cu_{46}Zr_{47}Al_7$ alloy composed of constituents having a negative enthalpy (the comparison example 1: the curve (a) in FIG. 2), the strain to failure is 2.8% and plastic strain (elongation) is less than 1%.

On the contrary to this, in case of the $Cu_{46}Zr_{45}Al_7Y_2$ (the example 1: the curve (b) in FIG. 2) and $Cu_{46}Zr_{42}Al_7Y_5$ alloys (the example 2: the curve (c) in FIG. 2), where part of zirconium Zr in the above $Cu_{46}Zr_{47}Al_7$ alloy of the invention is substituted with yttrium Y according to the invention, the strain to failure is 5.21% and 4.97% respectively, and the plastic strain is more than 3%.

This is, it can be understood from the above results that, in an amorphous alloy, part of an element providing a negative mixing enthalpy (for example, Zirconium) can be substituted with a certain element capable of providing a positive mixing enthalpy (for example, yttrium) according to the present invention, so that the plastic deformation rate therefor can be significantly improved.

Figure 3:
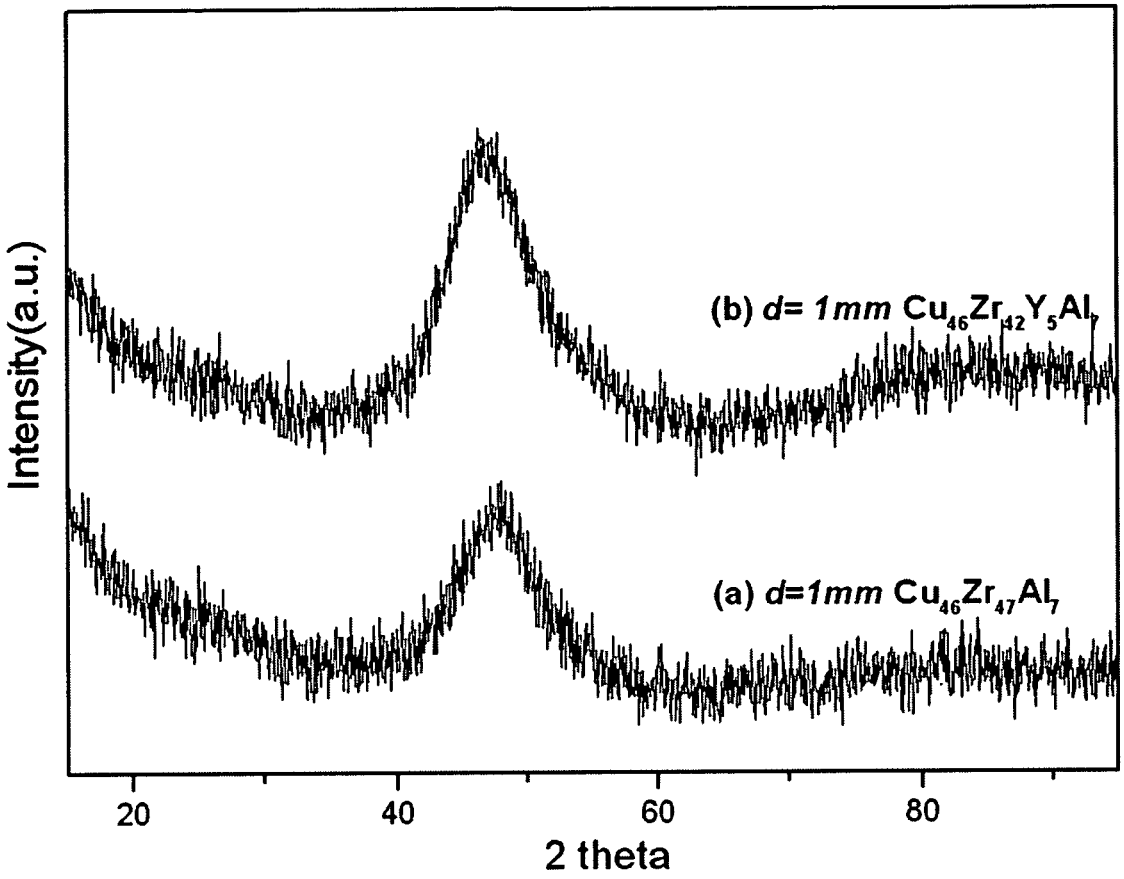
FIG. 3 is a graph showing a high resolution neutron diffraction analysis for an example composition $Cu_{46}Zr_{42}Al_7Y_5$ according to the invention and a comparison example composition $Cu_{46}Zr_{47}A_{17}$ according to the conventional amorphous technology.

FIG. 3 is a graph showing a high-resolution neutron diffraction analysis for an example composition $Cu_{46}Zr_{42}Al_7Y_5$ according to the invention and a comparison example composition $Cu_{46}Zr_{47}A_{17}$ according to the conventional amorphous technology. Here, the alloy $Cu_{46}Zr_{47}Al_7$ (the comparison example 1) is composed of alloying elements providing a negative mixing enthalpy, and the $Cu_{46}Zr_{42}Al_7Y_5$ alloy (the example 2) is formed by substituting part of Zirconium in the $Cu_{46}Zr_{47}Al_7$ with yttrium Y, which is capable of providing a positive value of mixing enthalpy. The HANARO utility reactor in the Korean Atomic Energy Research Institute was used as the neutron beam source for the high-resolution neutron diffraction analysis.

The high-resolution neutron diffraction analysis is known to provide a higher resolution, as compared with the X-ray diffraction analysis, which is widely used in phase analysis.

As can be seen from FIG. 3, the alloy composition of the invention having a thickness of 1 mm exhibits a typical halo pattern, which is characteristic of an amorphous material. Thus, it has been found that, according to the invention, a single-phase amorphous structure can be achieved having the thickness of above 1 mm.

Figure 4:
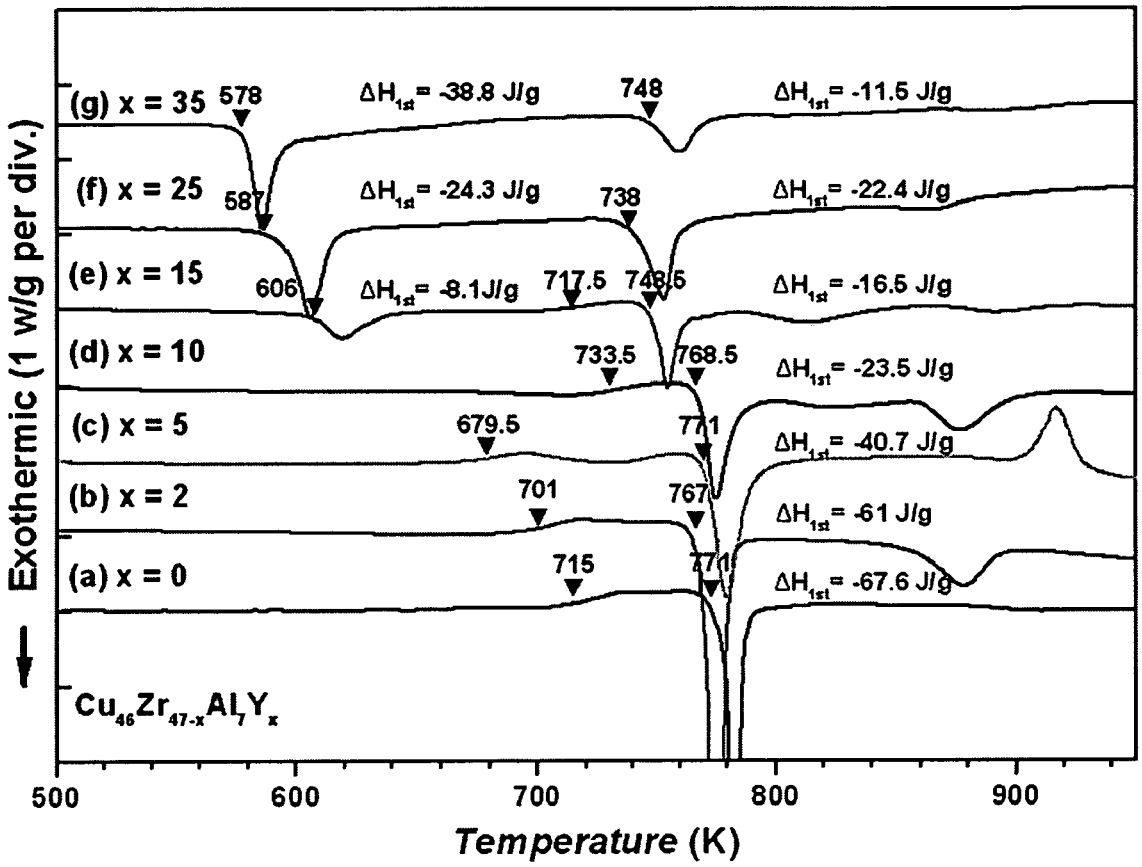
FIG. 4 shows the result of a differential thermal analysis for an alloy system $Cu_{46}Zr_{47-x}Al_7Y_x$ (x=0~35) according to the invention.

FIG. 4 is the result of a differential thermal analysis for an alloy system $Cu_{46}Zr_{47-x}Al_7Y_x$ (x=0~35) according to the invention. As understood from FIG. 4, in case of the $Cu_{46}Zr_{47}Al_7$ alloy (x=0) (the curve (a) in FIG. 4), which consists of alloying elements providing a negative mixing enthalpy relationship, only a crystallization behavior related to the amorphous Cu—Zr—Al alloy occurs around 780° K.

Dissimilar to this, in case of an alloy containing above 15% of yttrium, i.e., $Cu_{46}Zr_{32}Al_7Y_{15}$ alloy (the curve (d) in FIG. 2 and the curve (e) in FIG. 4), a crystallization behavior related to the Cu—Y—Al amorphous alloy occurs around 600° K, along with the crystallization behavior related to the Cu—Zr—Al amorphous alloy around 760° K, as shown in FIG. 4.

As understood from the above results, if the yttrium Y providing a positive mixing enthalpy with zirconium Zr is added in an appropriate amount, the mechanical properties therefor is improved. However, if the yttrium is added excessively, it creates an excessive repulsive force between zirconium and yttrium and consequently a phase separation is caused between the Cu—Zr—Al system and the Cu—Y—Al system. The phase separation phenomenon leads to formation of the interface in-between, and thus comes to exhibit poor mechanical properties, as shown in the curve (d) in FIG. 2.

In this way, part of constituents having a negative heat of mixing is substituted with a certain element having a positive heat of mixing. As the amount of the substituted element increases, the compositional fluctuation range increases, thereby facilitating the phase separation between the amorphous phases and also the crystallization thereof.

Therefore, in the general composition $A_{100-a-b}B_aC_b$ of the invention where a and b are respectively $0<a<15$, $0\leqq b\leqq 30$ in atomic percent, the constituent B, i.e., an alloying element having a positive heat of mixing (for example, yttrium Y) is limited to less than 15 atomic percent according to the invention.

Here, the constituent C is a minor element, which is added for improving the amorphous formation ability. If this element C is added above 30%, the glass transition temperature is decreased, which is closely related to the rupture strength of an amorphous alloy. In general, the amorphous material exhibits its inherent amorphous characteristics below the glass transition temperature therefor. Thus, in case where the element C of above 30% is added, the rupture strength thereof is decreased and a range of temperature over which the amorphous alloy can be utilized is also lowered. That is, above 30% of C imposes negative effects on the resultant alloys and thus no more than 30% is preferred. In certain circumstances, the constituent C may not be required as long as other elements form an amorphous structure adequately.

From the above results, it has been found out that a certain atom (for example, yttrium atom) having a positive heat of mixing with other alloying elements can be added within a certain predetermined content range to thereby enhance the plastic strain characteristic of a single-phase amorphous structure.

With the amorphous alloy of the invention having the above-described characteristics, in order to analyze variation of the mechanical properties with the composition of alloy, several samples were prepared and their properties were confirmed as follows.

First, a rod-shape specimen was fabricated using an injection casting process.

That is, each alloy composition listed in Table 1 is loaded inside a transparent quartz tube in a chamber, the vacuum of which was about 20 cmHg, and melted using a high frequency induction furnace under argon gas atmosphere of about 7~9 KPa. Then, at the state where the melted alloy was held inside the quartz tube by means of the surface tension of the melted alloy, argon gas of about 50 KPa was injected into the quartz tube before the melted alloy was reacted with the quartz tube, while rapidly lowering the quartz tube. In this way, the melted alloy was filled into a water-cooled copper mold, thereby producing a rod-shaped specimen having a length of 40 mm and a diameter of 1 mm.

The compression test for the rod specimen of 1 mm diameter×2 mm height was carried out at the strain rate of $1\times10^{-4}$/s.

TABLE 1

Comparison of mechanical properties (composition: atomic %)

| Division | Composition (at %) | $\sigma_f$(GPa) | $\epsilon_f$(%) | $d_{max}$ (mm) |
|---|---|---|---|---|
| Example 1 | $Cu_{46}Zr_{45}Al_7Y_2$ | 1.87 | 5.21 | ≧8 |
| Example 2 | $Cu_{46}Zr_{42}Al_7Y_5$ | 1.75 | 4.97 | ≧10 |
| Example 3 | $Cu_{47}Ti_{33}Zr_7Ni_8Si_1Nb_4$ | 2.17 | 6.05 | ≧5 |
| Example 4 | $Ni_{59}Zr_{16}Ti_{13}Si_3Sn_2Nb_7$ | 2.9 | 8.2 | ≧5 |
| Example 5 | $Ni_{61}Zr_{22}Al_4Nb_7Ta_6$ | 3.08 | 5.0 | ≧2 |
| Example 6 | $Mg_{65}Cu_{20}Ag_5Gd_{10}$ | 0.91 | 2.21 | ≧11 |
| Example 7 | $Ti_{51}Zr_{18}Ni_6Cu_7Be_{14}Nb_4$ | 2.01 | 7.2 | ≧1 |
| Example 8 | $Zr_{49}Al_{16}Cu_{25}Co_{10}$ | 2.27 | 9.7 | ≧1 |
| Example 9 | $Zr_{59}Cu_{18}Ni_8Al_{10}Ta_5$ | 1.70 | 8.8 | ≧1 |
| Example 10 | $Cu_{55}Zr_{30}Ti_{10}Ag_5$ | 1.99 | 6.3 | ≧4 |

TABLE 1-continued

| Division | Composition (at %) | $\sigma_f$(GPa) | $\epsilon_f$(%) | $d_{max}$(mm) |
|---|---|---|---|---|
| | Comparison of mechanical properties (composition: atomic %) | | | |
| Comparison Example 1 | $Cu_{46}Zr_{47}Al_7$ | 1.96 | 2.8 | ≧3 |
| Comparison Example 2 | $Cu_{46}Zr_{32}Al_7Y_{15}$ | 1.09 | 1.09 | <1 |
| Comparison Example 3 | $Cu_{47}Ti_{33}Zr_{11}Ni_8Si_1$ | 2.09 | 3.25 | ≦4 |
| Comparison Example 4 | $Ni_{59}Zr_{20}Ti_{16}Si_2Sn_3$ | 2.7 | 4.1 | ≦3 |
| Comparison Example 5 | $Mg_{65}Cu_{25}Gd_{10}$ | 0.84 | 1.98 | ≦8 |
| Comparison Example 6 | $Mg_{65}Cu_5Ag_{20}Gd_{10}$ | 0.89 | 1.82 | <1 |
| Comparison Example 7 | $Ti_{55}Zr_{18}Ni_6Cu_7Be_{14}$ | 2.07 | 1.98 | — |
| Comparison Example 8 | $Zr_{52.6}Al_{21.4}Cu_{10}Co_{16}$ | 1.64 | 1.31 | — |

As understood from Table 1, the alloy systems of comparison examples 1 to 8, which have a negative mixing enthalpy between constituent elements in order to enhance the glass forming ability, exhibited about 2% of elastic elongation, as expected. In some cases, for example, the comparison examples 1, 3 and 4 exhibited a slight plastic deformation behavior.

In case of the single-phase amorphous alloy systems of the invention, however, part of the alloying elements added in order to improve the glass forming ability was substituted with other elements capable of providing a positive value of mixing enthalpy. Consequently, as can be seen from Table 1, an enhanced plastic elongation of above about 3% could be achieved, except for magnesium-based amorphous alloys.

From the above result, It has been found out that the compositional fluctuation resulting from the difference in bonding forces between constitutional elements can contribute to plastic deformation in amorphous alloys, dissimilar to the conventional method of providing fine or ductile crystalline precipitates.

Generally, magnesium-based amorphous alloys are known to exhibit brittle fracture behavior due to its lower glass transition temperature (Tg) and melting temperature (Tm). However, the Mg amorphous alloy according to the invention (the example 6) has been found to have a yield behavior and a partial plastic deformation.

In Table 1, the example 1 ($Cu_{46}Zr_{45}Al_7Y_2$ alloy) and the example 2 ($Cu_{46}Zr_{42}Al_7Y_5$ alloy) have a positive mixing enthalpy of +9 between Zr and Y. The example 3 ($Cu_{47}Ti_{33}Zr_7Ni_8Si_1Nb_4$ alloy), the example 4 ($Ni_{59}Zr_{16}Ti_{13}Si_3Sn_2Nb_7$ alloy) and the example 7 ($Ti_{51}Zr_{18}Ni_6Cu_7Be_{14}Nb_4$ alloy) have a positive mixing enthalpy of +4 between Zr and Nb and a positive mixing enthalpy of +2 between Ti and Nb. In addition, the example 5 ($Ni_{61}Zr_{22}Al_4Nb_7Ta_6$ alloy) has a positive mixing enthalpy of +4 and +3 between Zr and Nb and between Zr and Ta respectively. The example 6 ($Mg_{65}Cu_{20}Ag_5Gd_{10}$ alloy) and the example 10 ($Cu_{55}Zr_{30}Ti_{10}Ag_5$ alloy) have a positive mixing enthalpy of +2 between Cu and Ag. The example 8 ($Zr_{55}Al_{16}Cu_{25}Co_{10}$ alloy) has a positive mixing enthalpy of +6 between Cu and Co. Therefore, these exemplary alloys conform well to the principles of the present invention, where the alloying elements are selected in such a way that part of elements providing a negative mixing enthalpy is substituted with a certain atomic element exhibiting a positive value of mixing enthalpy.

Here, the above values of mixing enthalpy are quoted from Cohesion in Metals, Cohesion and structure Vol. 1, F. R. de Boer, R. Boom, W. C. M. Mattens, et al. (1988).

In Table 1, the comparison examples 1, 3, 4, 5 and 7 (a=0 in the composition $A_{100-a-b}B_aC_b$ of the invention) does not have an element having a positive mixing enthalpy with the component A of the composition $A_{100-a-b}B_aC_b$. In case of the comparison examples 2, 6, and 8 (respectively a=15, 20, 16 in the composition $A_{100-a-b}B_aC_b$ of the invention), an alloying element capable of having a positive value of mixing enthalpy with the component A was added, but the content thereof was above 15%. Thus, the comparison examples 2, 6 and 8 are thought to have failed to exhibit the mechanical properties as in the examples in accordance with the present invention.

As described above, according to the present invention, part of constituent elements of an amorphous alloy is substituted with a certain element capable of providing a positive value of mixing enthalpy so that the amorphous structure thereof can have a plasticity at ambient or room temperature, thereby broadening the application range of amorphous alloys.

In addition, the conventional bulk amorphous materials have a limitation in its structural applications since it exhibits a rapid failure behavior without plastic deformation after the elastic region thereof. In contrast, the single-phase amorphous alloy of the invention can be plastically deformed at room temperature, thereby allowing for its structural applications.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A single-phase amorphous alloy having a plastic strain of 3% or more at ambient room temperature, the alloy having a composition range consisting of $A_{100-a-b}B_aC_b$ where a and b are respectively $1 \leqq a < 15$, $0 \leqq b \leqq 30$ in atomic percent, wherein A includes at least one element selected from the group consisting of Be, Ti, Zr, Ni, and Cu, B includes at least one element selected from the group consisting of Y, La, Gd, Nb, Ag, Au, and Co, and C includes at least one element selected from the group consisting of In, Sn, B, C, Si, and P.

2. The amorphous alloy as claimed in claim 1, wherein A includes Ni, Cu, Zr, and Ti, B includes Nb, and C includes Si.

3. The amorphous alloy as claimed in claim 1, wherein A includes Ni, Zr, Ti, B includes Nb, and C includes Si and Sn.

4. The amorphous alloy as claimed in claim 1, wherein A includes Cu, Zr, and Ti, B includes Ag.

5. The amorphous alloy as claimed in claim 1, wherein A includes Ti, Ni, Cu, and Be, B includes Nb.

* * * * *